United States Patent [19]

Knudson

[11] Patent Number: 4,470,186

[45] Date of Patent: Sep. 11, 1984

[54] REVERSIBLE SEAMING APPARATUS WITH LATERALLY SEPARABLE ROLLERS HAVING PARALLEL AXES

[76] Inventor: Gary A. Knudson, 17356 W. 57th Ave., Golden, Colo. 80401

[21] Appl. No.: 441,382

[22] Filed: Nov. 12, 1982

Related U.S. Application Data

[63] Continuation-in-part of Ser. No. 262,216, May 11, 1981, abandoned.

[51] Int. Cl.[3] ..... B23P 11/00

[52] U.S. Cl. ..... 29/243.5

[58] Field of Search ..... 29/243.5, 243.57, 243.58; 72/210, 248

[56] References Cited

U.S. PATENT DOCUMENTS

| | | | |
|---|---|---|---|
| 2,160,336 | 5/1939 | Maxfield . | |
| 2,160,336 | 5/1939 | Maxfield | 29/243.5 |
| 3,015,293 | 1/1962 | Parham . | |
| 3,609,845 | 10/1971 | Taylor | 29/243.5 |
| 3,662,699 | 5/1972 | Horn et al. | 29/243.5 |
| 3,771,482 | 11/1973 | Thompson . | |
| 3,771,482 | 11/1973 | Thompson | 29/243.5 |
| 3,875,642 | 4/1975 | Knudson . | |
| 3,875,642 | 4/1975 | Knudson | 29/243.5 |

*Primary Examiner*—James L. Jones, Jr.

*Attorney, Agent, or Firm*—Fields, Lewis, Pittenger & Rost

[57] ABSTRACT

Seaming apparatus has two sets of opposed seaming rollers (21, 22 and 23, 24) rotatably mounted on a base (20) and positioned so that the sets successively engage and track on opposite side edge portions of the panel and bend a terminal side section (17) under to form a continuous seam. A drive motor (111) and drive train (81, 82, 83, 84, 113) between the motor and rollers provides a direct positive drive for each roller. One roller of each set is mounted on a slidable base portion (27) that provides for varying the roller spacing and is removable from a main base (26) and reinsertable thereinto along the opposite side to reverse roller positions. Modified forms of seaming apparatus have two spaced slide bores (335) in blocks (333) sandwiched between spaced plates (331, 332) with thrust pins 341 slidable in the bores for guided movement of two base portions (326, 327). A dual clevis (370) on a single actuator arm (363) and detents (382) on the inboard base portion with springs (350) between the base portions move and lock the base portions. Pin (401) and slot (402) couplings are disclosed for interchanging the outboard rollers or a duplicate set of leading rollers (531 and 532) is used on the opposite ends of the base portions for reversing the direction of the seaming apparatus.

20 Claims, 21 Drawing Figures

REVERSIBLE SEAMING APPARATUS WITH LATERALLY SEPARABLE ROLLERS HAVING PARALLEL AXES

This application is a continuation-in-part of application Ser. No. 262,216, filed May 11, 1981 now abandoned.

TECHNICAL FIELD

This invention relates to a novel and improved seaming apparatus for joining the side edge portions of adjacent panels together by forming a longitudinally continuous connecting seam.

BACKGROUND ART

In my U.S. Pat. No. 3,875,642 there is disclosed a seaming apparatus utilizing three sets of rollers that is particularly suited for forming continuous seam structure along the side edges of panels having vertical sidewall portions arranged parallel to one another and side connecting flanges that extend laterally out from the upper edge of vertical sidewall portions.

Maxfield U.S. Pat. No. 2,160,336 discloses non-reversible seaming apparatus wherein the movable rollers are not on a common base and the axes of the rollers do not remain parallel during movement.

Parham U.S. Pat. No. 3,015,293 discloses a non-reversible seaming apparatus wherein only a single rod through the center of the block is used to support the base portions for guided movement and the rollers do not embrace at least a side section and corner of an outer inverted channel to facilitate tracking in the channel.

Thompson U.S. Pat. No. 3,771,482 discloses a non-reversible seaming apparatus wherein separate bases are used for the movable rollers and more than two sets of rollers are required to form the seam.

The seaming apparatus of the present invention provides another approach to seaming panels and has been found to be particularly suited for forming continuous seam structure in adjacent panels that have inclined sidewall portions and raised side edge portions. These panels are disclosed in more detail in a copending application of the same inventor entitled "Wide Panel, Panel Assembly, and Panel Forming Apparatus," Ser. No. 236,832.

DISCLOSURE OF INVENTION

Seaming apparatus disclosed includes a supporting frame on which there are rotatably mounted two sets of opposed seaming rollers, the sets being spaced from one another along the apparatus to successively engage the side edge portions of two adjacent panels. One roller of each set is movable toward and away from the other roller of each set between a closely spaced seaming position and a laterally separated release position. The seaming rollers have peripheral surfaces of a particular shape to track on opposite sides of the side edge portions and bend in a terminal side section of one panel under a lateral flange section of the other panel. One roller of each set is removable and each roller is interchangeable and the machine is reversible so as to perform different bends and is adapted to be used in two pass operations with different rollers in each pass for forming tighter seams.

BRIEF DESCRIPTION OF DRAWINGS

The details of this invention will be described in connection with the accompanying drawings, in which.

DETAILED DESCRIPTION

Figure 1:
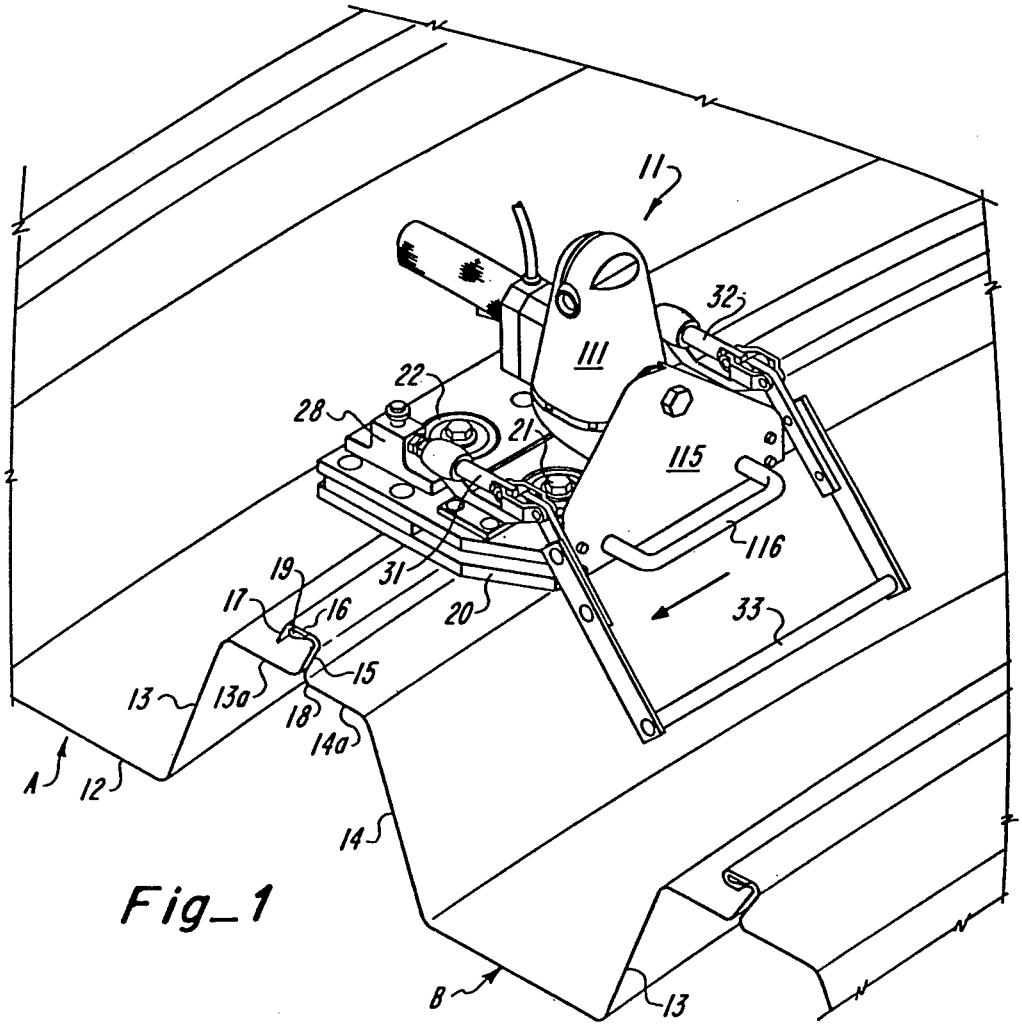
FIG. 1 is a perspective view of a seaming apparatus embodying features of the present invention mounted in an operating position on the side edge fastening portions of two adjacent building panels.

Referring now to FIGS. 1-7, a self-propelled seaming apparatus designated by numeral 11 is shown in an operating position seaming together the side edge portions of two adjacent building panels A and B. The seaming takes place as the seaming apparatus 11 moves from right to left as indicated by the arrow. Each building panel A and B shown is of the construction described in detail in the above-mentioned copending application. Each panel is of the same construction and has an intermediate portion 12 and inclined sidewall portions 13 and 14 extending up and out from the intermediate portion 12.

Sidewall portion 13 has a raised inturned side edge portion extending up from a lateral wing portion 13*a* including an upstanding side section 18 and a lateral flange section 19 of double thickness to provide an inturned laterally extending male joint portion. Sidewall portion 14 has a raised side edge portion extending up from a lateral wing portion 14*a* including an upstanding side section 15, a lateral flange section 16, and a downturned terminal section 17 forming an inverted, open channel to provide an outturned female joint portion. In the assembly, the male joint portion in one panel inserts into and nests within the female joint portion.

The panel seaming apparatus 11, generally stated, includes a supporting means or base 20 together with two sets of first and second opposed seaming rollers 21 and 22 and third and fourth opposed seaming rollers 23 and 24 rotatably mounted thereon, the sets being spaced from one another along base 20.

As shown, the side edge portions of the adjacent building panels A and B being seamed together are successively engaged by the leading set of rollers 21 and 22 in a first stage bending operation and then by the trailing set of rollers 23 and 24 in a second stage bending operation. The first set 21 and 22 is spaced from and alined with the second set 23 and 24 along the apparatus so as to successively engage the panel as the sets move along the panel.

The seaming apparatus 11 will operate when moved in either direction so that the terms "leading" and "trailing" as applied to the rollers will depend on the direction of movement of the apparatus. As used herein, the designations "leading" and "trailing" refer to the arrangement of the rollers and direction of movement described.

Seaming rollers (inboard) 22 and 24 are rotatably mounted on a main (first or inboard) base portion 26 and the rollers (outboard) 21 and 23 are rotatably mounted on a movable (second or outboard) base portion 27 that is laterally movable with respect to main base portion 26 to facilitate the lateral movement and also the reversing of one of the rollers of each set, as described more fully hereinafter. The movable base portion 27 is moved by and releasably connected to the main base portion 26 by the use of two clamping blocks 28 and 29 spaced along the base portion 27 which are bolted thereto and two push-pull clamps 31 and 32 releasably connected at one end to the clamping blocks 28 and 29, respectively. The clamps 31 and 32 are actuated by a common U-shaped roller position control lever 33.

Figure 3:
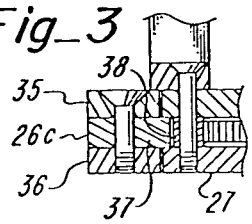
FIG. 3 is a sectional view taken along lines 3—3 of FIG. 2.

The main base portion 26 includes an intermediate section 26*a* extending lengthwise of the machine and a pair of transverse parallel-spaced leg sections 26*b* and 26*c* at the ends of the intermediate section 26*a*. As best seen in FIG. 3, a pair of upper and lower guide plates 35 and 36 are fastened to each of the leg sections by bolts to provide tongue-type, stepped, inner guide surfaces or guideways 37 for the guided movement of the sides of the movable base portion 26, which in turn has complementary shaped groove-type side surfaces 38. With this construction the movable base portion 27 slides laterally in and out of opposed guideways 37 in the main base portion much like a drawer. The movable base portion 27 is held in either the operating (first) position or the spread release (second) position by the clamping blocks 28, 29 and push-pull clamps 31, 32.

The releasable attachment between each push-pull clamp to the associated clamping block is provided by means of a reciprocally movable pin-like end member 40 on the end of a plunger 58. Member 40 has a smooth end portion 41 that inserts or telescopes in a lateral hole 42 in the clamping block 28. A locking pin 43 inserts down into a vertical hole 44 in the top of the clamping block and into a hole 45 in end portion 41. The vertical hole 44 has an enlarged bottom end portion 44*a* and the locking pin 43 has opposed reciprocally movable projections 46 that engage the shoulder provided by enlarged end portion 44*a* and the projections 46 contract into pin 43 to a pin release position by depressing a spring-biased button 47 at the top of pin 43. A second vertical hole 44*b* like vertical hole 44 is provided in the clamping block and a second pin hole 45*a* is provided in pin 40 at right angles to hole 45 for further positioning adjustment of the rollers in spaced relation to one another for different roller sizes, panels or the like.

When the locking pin 43 is removed the end member 40 is free to slide out from hole 42 in the associated clamping block. The end member 40 further has an externally threaded portion 48 opposite end portion 41 that projects beyond the block, with a nut 49 threaded thereon which limits the extent of insertion of end portion 41 into hole 42 and an adjustable nut 50 that limits the extent of the threaded insertion of the end member 40 into the clamp plunger 58. This arrangement allows adjustment of the spacing between rollers by the threading of nut 50 to a selected position.

The seaming apparatus is made reversible by releasing the end members 40 from the associated clamping blocks 28 and 29, sliding the movable base portion 27 out from the main base portion 26, turning the movable base portion around so that the rollers carried thereon reverse their positions, and then reattaching the end members 40 to the clamping blocks by inserting locking pins 43 in place. The direction of the shaft of motor 111 is reversed and the seaming apparatus will then travel along the next seam, moving in the opposite direction.

Push-pull clamp 31 is further shown to include a yoke-like mounting base 55 having a rear upstanding double lug 56 and a front tubular socket 57. The plunger 58 is slidably mounted in the socket 57 and secured at a forward end to the end member 40 and in turn to the clamping block 28 mounted on the laterally movable base portion 27, above described. A pair of links 61 and 62 are pivotally connected at adjacent ends to the rear end of the plunger 58 at a fixed pivot 63.

An actuator arm 65 has an offset end portion 66 that extends at an angle at the end thereof having one end pivotally connected to the yoke double lug 56 at a fixed pivot 68 and a knee portion opposite pivot 68 is connected to the pair of links 61 and 62 at a movable pivot 69 so that as the actuator arm 65 is moved the movable pivot 69 moves from a retracted position to an extended position corresponding to the operating and spread roller positions, respectively, above described.

In the retracted position the links 61 and 62 and the offset end portion 66 are end to end and in a straight-line horizontal position. In the extended position the links 61 and 62 are raised at the rear and offset end portion 66 is moved from an outboard position to an inboard position with the actuator arm 65 from a downwardly extending to an upwardly extending position, which pushes the plunger 58 and movable base portion 27 away from the main base portion 26. In the down position shown in FIG. 5 the movable base is locked in a fixed position to hold the roller against lateral movement.

Each of the seaming rollers 21, 22, 23 and 24 is rotatably mounted on the base 20 in the same manner. Rollers 21, 22, 23 and 24 are mounted on shafts 72, 71, 74 and 73, respectively, which in turn carry drive gears 82, 81, 84 and 83, respectively.

Figure 6:
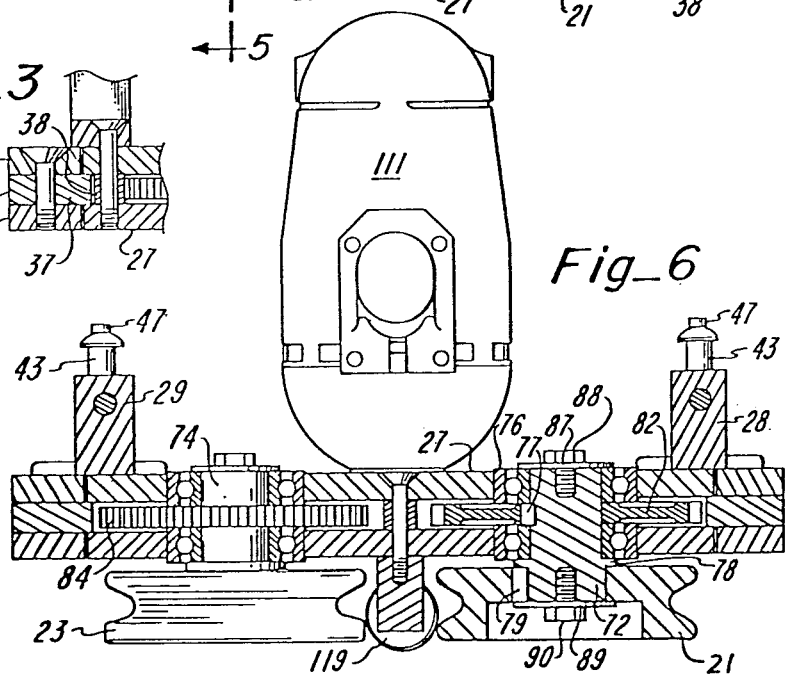
FIG. 6 is a sectional view taken along lines 6—6 of FIG. 2.
Figure 4:
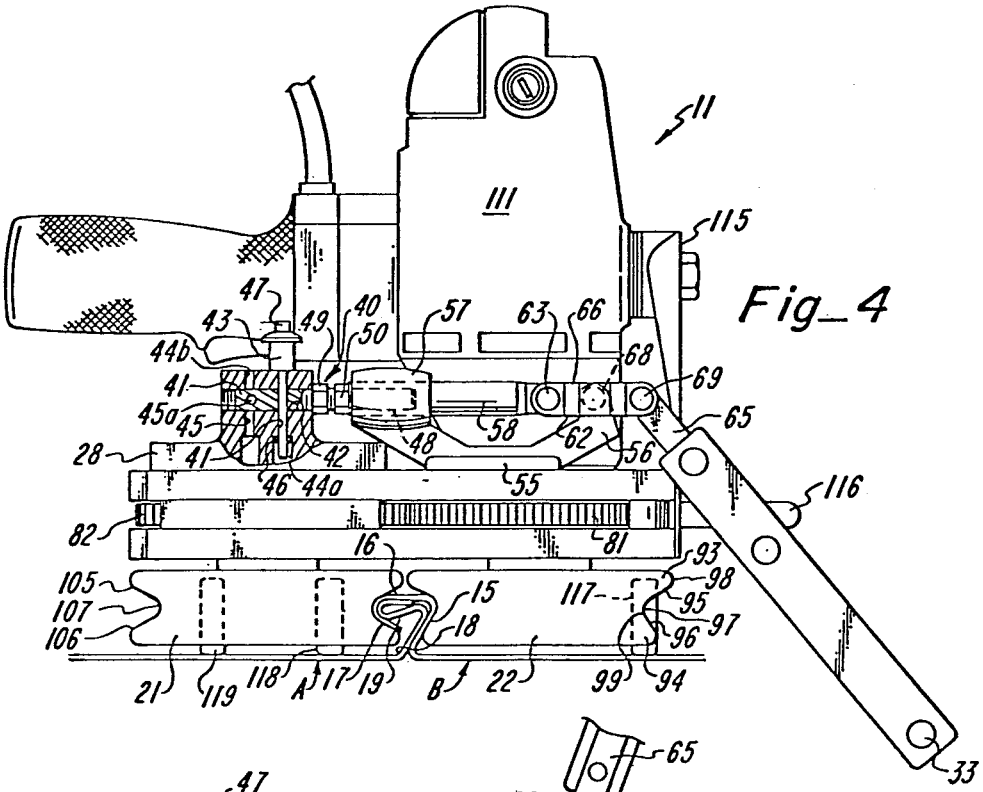
FIG. 4 is an elevational view of the seam forming apparatus shown in FIGS. 1 and 2 looking toward the trailing end.

The roller mounting is the same for each roller. Referring now to FIG. 6, and specifically to roller 21 and shaft 72, shaft 72 is shown as having an upper section of smaller diameter affixed to the inside race of a bearing 76 with the outer race of the bearing mounted on base portion 27. The drive gear 82 is affixed to this upper shaft section with a key 77 in a keyway in the upper shaft section. Shaft 72 has a lower section of greater diameter than the upper section to form a shoulder 78 that abuts against the underside of the bearing via a washer 91.

The roller 21 is secured to the lower shaft section with a key 79 in a keyway on the lower shaft section. An upper end washer 87 is mounted on a top bolt 88 that threads into an internally threaded hole in the top of the shaft and a lower end washer 89 is mounted on a bottom bolt 90 that threads into an internally threaded hole in the bottom of the shaft 72 to clamp the shaft to the inside race of the bearing 76. The roller 21 further has an internal bore extending axially into the bottom face sized to receive the bottom washer 89 and of a depth to recess the head of bolt 90 therein.

Referring now to the set of leading rollers 21 and 22, these rollers have the same external peripheral shape. Roller 22 may be generally described as having an inner hub and an outer rim. The outer rim includes a pair of opposed ridges 93 and 94 with opposed inclined sidewalls 95 and 96 defining a generally V-shaped peripheral groove 97 that embraces the corner juncture between angularly disposed sections 15 and 16 of the inturned side edge portion of the panel B. In addition, each ridge has a rounded crest portion 98 farthest from the inner hub and a rounded root portion 99 closest to the inner hub. In use, the opposed inclined sidewalls 95 and 96 track on the angularly disposed sections 15 and 16. Sidewalls 95 and 96 span an arc of 90°. Sidewall 95 is at an angle of 30° to the horizontal, which is normal to the axis of rotation, or turned at an angle of 60° to a line parallel to the axis of rotation of the roller. Sidewall 96 is at an angle of 60° to the horizontal, which is normal to the axis of rotation, or turned at an angle of 30° to a line parallel to the axis of rotation of the roller.

Roller 21 has the same shape as roller 22 and the periphery has inclined sidewalls 105 and 106 defining a V-shaped peripheral groove 107 that embraces the corner juncture between angularly disposed sections 16 and 17 of the outturned side edge portion of the panel. In use, the opposed inclined sidewalls 105 and 106 track on the angularly disposed sections 16 and 17 and bend the terminal side section 17 under the lateral flange section 19 of double thickness. In this way the set of rollers form opposed open V-shaped grooves that are moved in from opposite sides to clampingly engage the side edge portions of the panels.

Roller 24 has the same peripheral shape as rollers 21 and 22 and embraces sections 15 and 16 as does roller 22.

Figure 5:
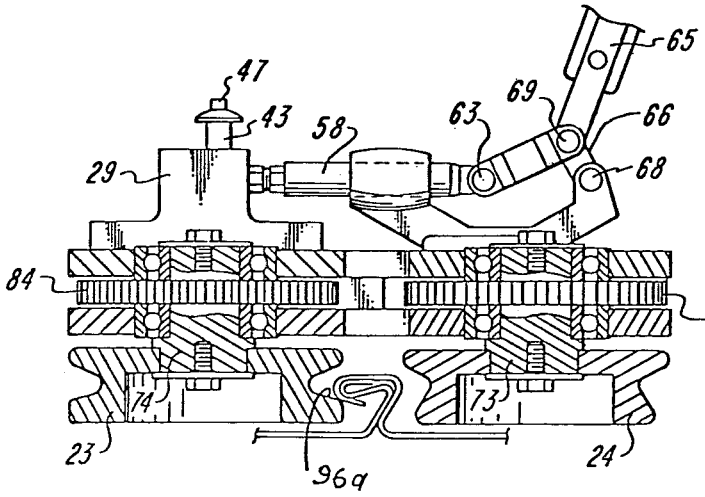
FIG. 5 is a sectional view taken along lines 5—5 of FIG. 2 with the rollers in the spread release position.

Roller 23 on movable base portion 27 and in line with roller 21 is provided with a surface **96*a* that is 30° to the horizontal to form a 60-degree groove so as to turn the terminal side section up another 30°, as shown in FIG. 5. This leaves the terminal section 17** extending down at about a 30-degree angle to the horizontal after one pass of the machine.

Figure 7:
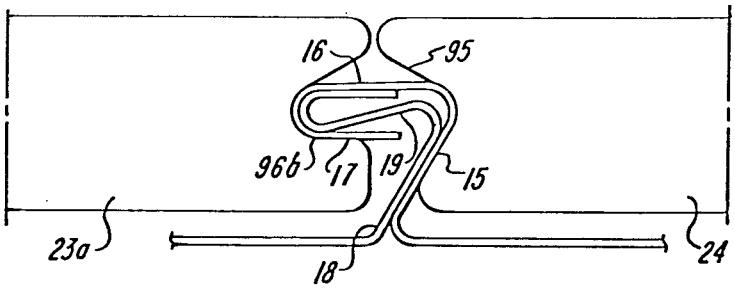
FIG. 7 is an elevational view of another seaming roller shape suitable for the second stage of a second seamer pass for forming a tighter seam.
Figure 10:
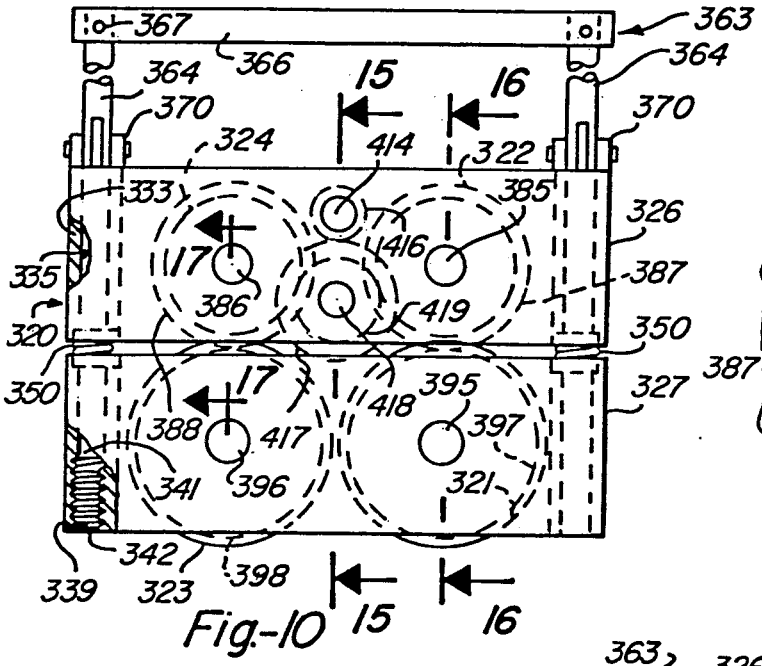
FIG. 10 is a top plan view of another form of seaming apparatus shown in the seaming position with the outline of the gears and rollers shown in dashed lines.
Figure 11:
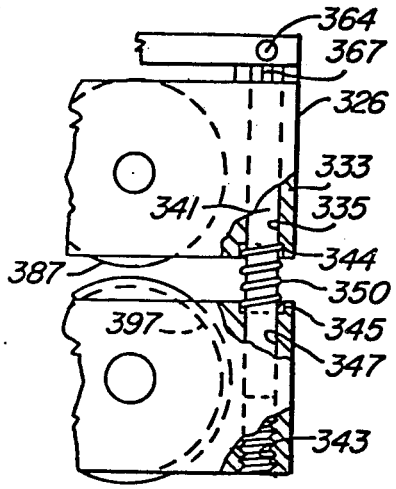
FIG. 11 is a fragmentary top plan view of an end portion of the seamer shown in the open position.
Figure 12:
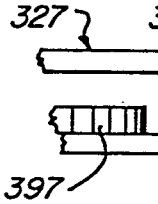
FIG. 12 is a fragmentary side elevation view showing the end portion of the outboard base portion.

Referring now to FIG. 7, another seamer roller **23*a* is shown which includes a surface 23*b* that is almost horizontal to provide a V-shaped groove in the roller 23*a* of slightly more than 30° to turn the terminal side section 17 to approximately a horizontal position and form a tighter seam. In practice, the seaming apparatus would make a first pass using the rollers shown in FIGS. 1–5 and then a second pass using roller 23 as the leading roller and roller 23*a* as the trailing roller. These rollers can be readily positioned on a second movable base portion 27** and readily inserted into place, as above described, for making the second pass and a tighter seam.

The drive for the above described seaming rollers includes a reversible electric motor 111 mounted on base 20 having an output shaft 112 and a power transmission train which includes a main drive gear 113 mounted on the motor shaft 112. Gear 113 meshes with gears 81 and 83 whereby the rotation of the motor shaft 112 causes the rollers 22 and 24 to rotate.

Gear 81 in turn meshes with a gear 82 and gear 83 meshes with gear 84 when movable base portion 27 is disposed in the retracted position to transmit power to rollers 21 and 23, respectively. A slot 120 is provided in the movable base portion to permit the user to make certain the opposed drive gears are meshing in the operating position.

The apparatus shown includes a cover plate 115 and a handle 116 mounted on base 20 for gripping by the user.

A guide roller 117 is mounted on base portion 26 and a pair of guide rollers 118 and 119 are mounted on base portion 27 and bear against sections **13*a* and 14*a*** of the panel to hold the seaming rollers in position relative to the panel surfaces.

Figure 8:
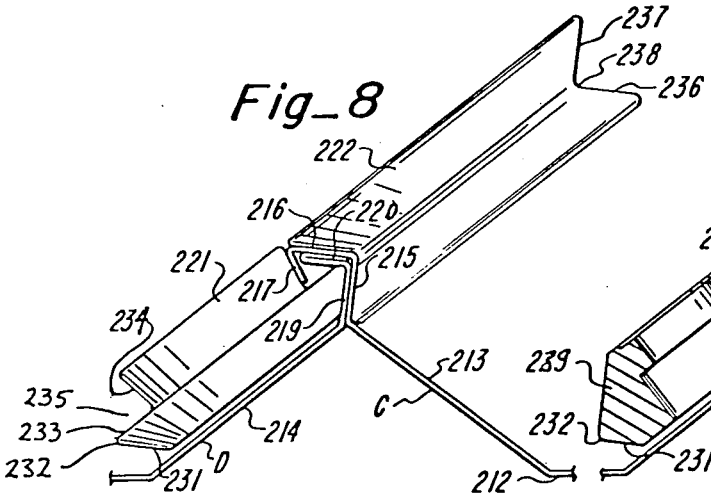
FIG. 8 is another form of seaming roller arrangement for the first seaming stage of another panel configuration.
Figure 9:
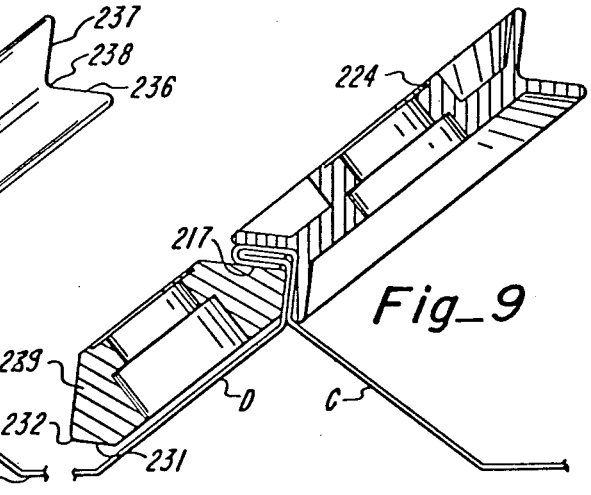
FIG. 9 is another form of seaming roller arrangement for the second seaming stage of the panel configuration shown in FIG. 8.
Figure 2:
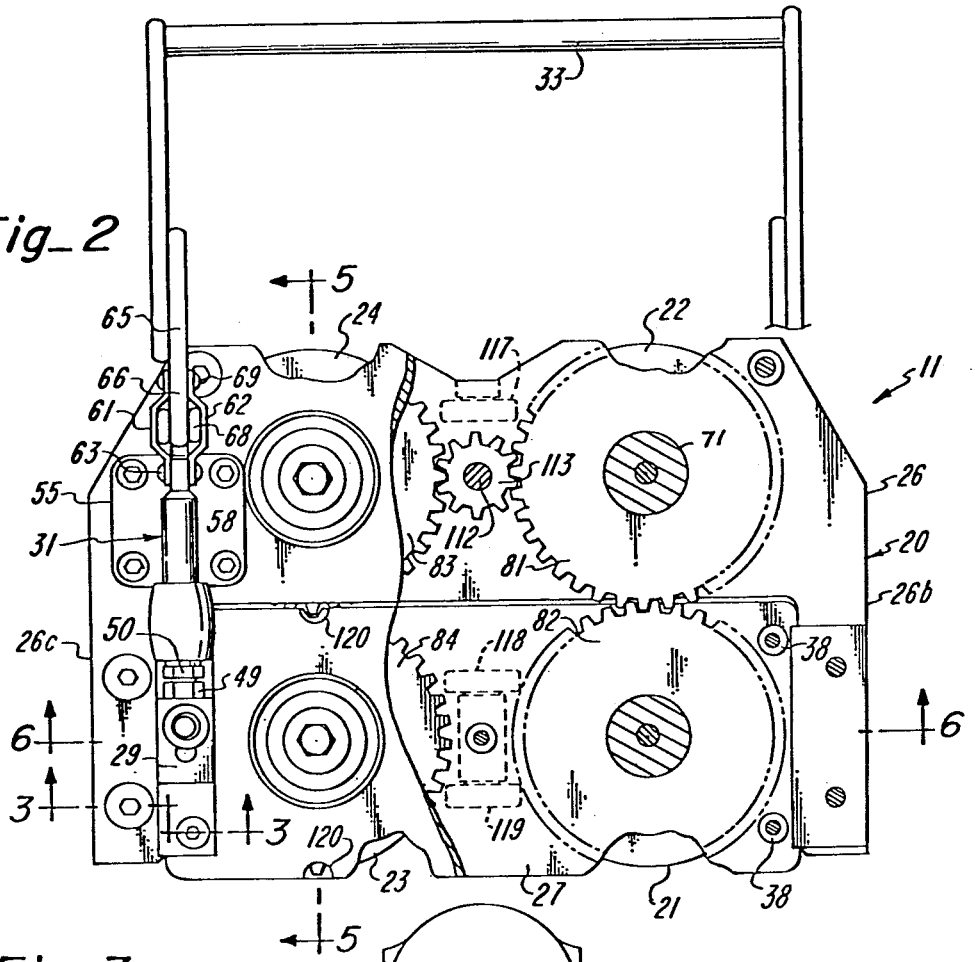
FIG. 2 is a top plan view of the seaming apparatus shown in FIG. 1 with portions removed and external portions broken away to show interior parts and with the seaming rollers in the operative seaming position.

Referring now to FIGS. 8 and 9, there is shown a modified panel (herein referred to as an expanded panel) having an intermediate portion 212 and a pair of inclined sidewall portions 213 and 214 turned up from the plane of intermediate portion 212 at about 40°. The side edge portions on the panel include a vertical side section 215, an outturned flange section 216, and a downturned terminal section 217 forming an inverted open channel or female joint portion on the upper side edge of sidewall portion 213 of panel C, and a vertical section 219 and inturned lateral flange section 220 of double thickness forming a male joint portion on the upper side edge of sidewall portion 214. As with the previously described panel, the female portion nests in the male joint portion prior to seaming.

Roller 221 of a leading set has a peripheral surface 231 at a 45-degree bevel that engages panel section 219 and a rounded corner 232 that bears against the corner juncture between sections 219 and 220, together with a radially extending surface 233 opposite a surface 234 disposed at an angle of 20° to the roller axis to form a V-shaped groove 235. Surface 234 engages the panel terminal section 217 to fold it under section 220.

Rollers 222 and 224 are of a similar shape. Roller 222 opposite roller 221 has two surfaces 236 and 237 disposed at an angle of 90° to one another, forming a V-shaped groove 238 which embraces the panel sections 215 and 216, respectively.

Roller 223 opposite roller 224 has the same surface 231 and corner 232 as roller 221 but has a surface 239 at an angle of 35° to a radial line that turns the terminal section 217 back under panel section 220 to form the seam. In this arrangement the rollers are set at an angle to the intermediate bottom portion 212 of the panel but the operation is generally the same as that of the rollers above described.

The seaming apparatus shown in FIGS. 10–18 has a two-part supporting base 320 including an inboard (first) base portion 326 and an outboard (second) base portion 327 arranged side by side.

A first set of seaming rollers, which consists of outboard roller 321 and inboard roller 322, is mounted on base portions 327 and 326, respectively. A second set of seaming rollers, which consists of outboard roller 323 and inboard roller 324, is mounted on base portions 327 and 326, respectively. The inboard seaming rollers 322 and 324 are mounted on the inboard base portion 326, while the outboard rollers 321 and 323 are mounted on the outboard base portion 327.

The inboard base portion 326 shown is constructed of an inboard upper plate 331 and an inboard lower plate 332 having a pair of identical inboard spacer blocks 333 at opposite ends sandwiched between the plates to form the end walls of the base portion. These spacer blocks 333 provide a pair of end body portions in which there are formed a pair of inboard slide bores 335 arranged parallel to one another and extending transversely to the sidewalls of the two base portions. Similarly, the outboard base portion 327 has an outboard upper plate 337 and an outboard lower plate 338 with a pair of outboard spacer blocks 339 at opposite ends sandwiched between the plates.

A thrust pin 341 has external threads 342 on one end portion that thread into internal threads 343 in each outboard spacer block 339. Each pin extends through an associated outboard bore 347 in the outboard spacer blocks 339 and then extends through the slide bores 335 in the associated inboard spacer block 333. End portions of each pin 341 extend beyond the outer sidewall of the inboard base portion. This arrangement of alined blocks with slide pin extending therethrough joins the two base portions for guided movement toward and away from one another between a seaming position and a spread position. In practice the thrust pin is made of hardened steel and the spacer blocks of aluminum to provide low friction between dissimilar metals for natural lubrication.

A preferred assembly is to use four screw fasteners on each plate to fasten the blocks to the plates. This construction has been found easy to manipulate and maintains tolerances with less drag, less change for galling, and easier alinement. Moreover, because the centerline thrust pin is between the plates the thrust is closer to the centerline of resistance than in the form shown in FIGS. 1–9.

Inboard slide bores 335 and outboard bores 347 have oppositely facing enlarged bore sections 344 and 345, respectively, sized to receive and support a pair of compression springs 350 which bear against opposite surfaces of the two base portions to resiliently urge them apart.

A single actuator arm 363 in combination with springs 350 is used to effect the relative movement of the two base portions between seaming and spread positions. This actuator arm 363 includes a pair of lever rods 364 arranged parallel to one another and connected at the outer ends by an engagement bar 366. The ends of the rods 364 extend through holes in the engagement bar and set bolts 367 removably hold the engagement bar to the lever rods.

A clevis 370 is mounted on the end of each lever rod. Each clevis has a pair of spaced arms 372 extending out from a transverse base 374. Each lever rod 364 has external threads 371 that thread into internal threads 373 in the base 374. Two cam bearings 375 are mounted for rotation on the ends of the clevis arms by fastening screws 377. The outer end portion 378 of the thrust pin has a reduced width and extends in the space between the arms of the clevis. A shoulder bolt 379 extends through transverse holes in the clevis arms to mount the outer end of the thrust pin to pivot on the clevis about the center of the shoulder bolt 379, which is a pivot axis designated A.

Figure 13:
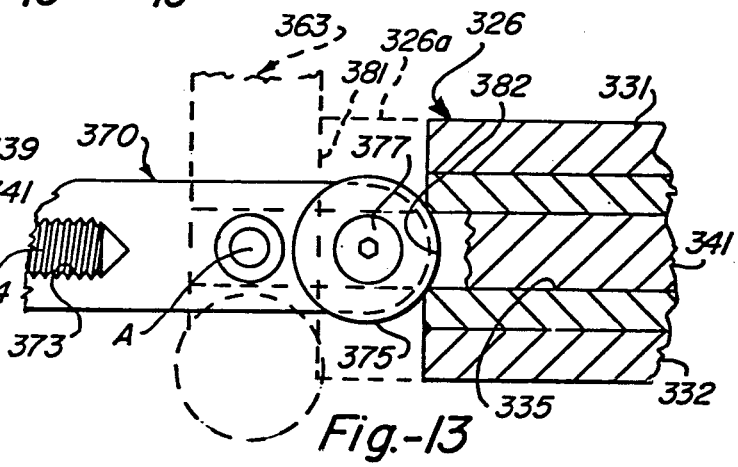
FIG. 13 is a side elevation view of the actuator arm in the seaming position with the open position shown in dashed lines and with a portion of the inboard base portion shown in section.
Figure 14:
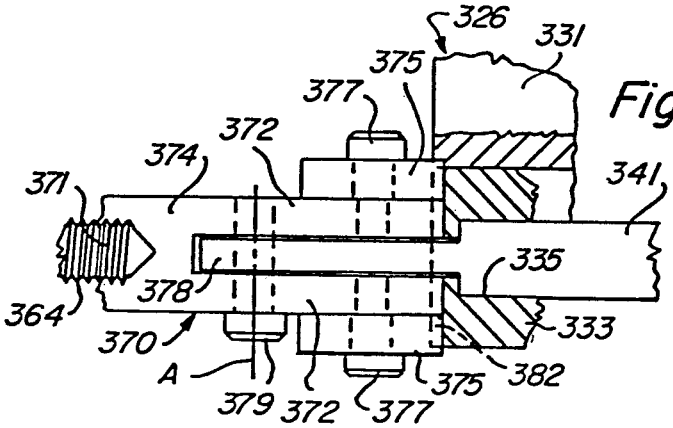
FIG. 14 is a top plan view of the actuator arm shown in FIG. 13.

Each clevis 370 has a side bearing surface 381 against which the outside face of the inboard base portion 326 is urged when the actuator arm 363 is in the raised position, as shown in FIG. 13 in dashed lines. The inboard base portion in the spread position is shown in dashed lines at 326*a*. The periphery of the cam bearings 375 provides an end bearing surface against which the inboard base portion is urged when the lever arm is in the lowered position, as shown in full lines in FIG. 13.

The inboard base portion 326 is formed with a pair of arcuate detents 382 into which the cam bearings 375 slide when the actuator arm is in the lowered position, and the compression springs, cams, and detent serve to releasably lock the base portions in the seaming position. In moving the actuator arm 363 from the raised position to the lowered position, the cam bearings 375 roll up against the outside base of the outboard base portion and then into the detents 382.

Inboard rollers 322 and 324 are mounted on shafts 385 and 386, respectively, which carry drive gears 387 and 388, respectively. A top bearing 391 mounts each shaft to the associated inboard upper plate 331 and a bottom bearing 392 mounts the shaft to the associated inboard bottom plate 332.

Outboard rollers 321 and 323 are mounted on outboard shafts 395 and 396, respectively, which also carry driven gears 397 and 398, respectively. A top bearing 399 mounts the outboard shaft 395 to the associated top plate 337 and a bottom bearing 400 mounts the shaft 395 to the associated bottom plate 338.

As with the apparatus described in FIGS. 1–9, the spacing between each of the sets of rollers in the release position is sufficient to permit the sets of rollers to be moved directly down over the inverted channel formed by the edge portions of the adjacent panels to allow the apparatus to be positioned for seaming or removal at any point along the panels.

The external shape of rollers 321 and 322 is the same as that of rollers 221 and 222 above described. The external shape of rollers 323 and 324 is the same as that of rollers 223 and 224 above described. In particular, the roller 322 has an inclined peripheral surface 389 turned to the axis of rotation from a parallel relation at an angle of 45° and an inclined peripheral surface 390 turned to the axis of rotation from a parallel relation at an angle of 45° to form the V-groove having an inside angle of 90° . Inclined peripheral surface 389 bears against upstanding side section 16 and peripheral surface 390 bears against outturned lateral flange section 16.

The outboard rollers 321 and 323 are interchangeable so that the seaming apparatus shown in FIGS. 10–18 is reversible. Each of these rollers is removably mounted by means of a transverse pin 401 on the end of the associated outboard shaft and a pair of axially extending slots 402 in the hub of the associated outboard roller. Each slot 402 is sized so that projecting end portions of the pin will slide through the slots as the roller is moved axially along the slots.

Two oppositely disposed hub segments 403 and 404 on the outboard roller are arranged along axes perpendicular to the axes of the slots 402. These hub segments provide a pair of shoulders against which the pin 401*a*, shown in dashed lines in FIG. 18, abuts for movement of the roller with the shaft when rotated in one direction and a second pair of shoulders against which the pin 401*b*, shown in dashed lines in FIG. 18, abuts to hold the roller so that it rotates with the shaft when rotated in the opposite direction.

Two depressible spring-biased buttons 407 are mounted on the hub on opposite sides of one of the slots 402 to prevent the pin from moving back away from the adjacent shoulder. To remove the outboard rollers the pin 401 is slid over one of the buttons and alined with the slots 402 and the roller is then moved axially along the slots.

Figure 15:
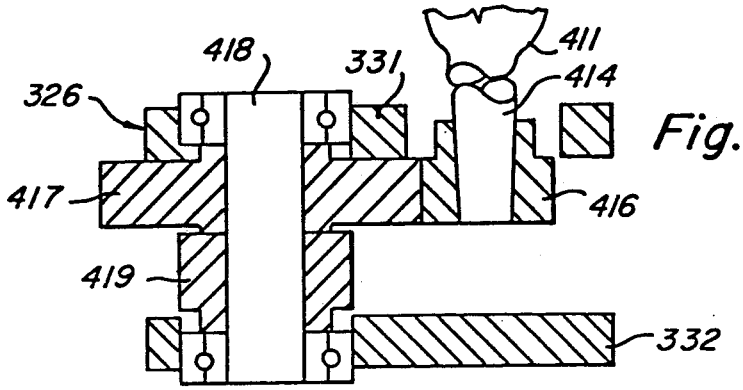
FIG. 15 is a sectional view taken along lines 15—15 of FIG. 10.
Figure 16:
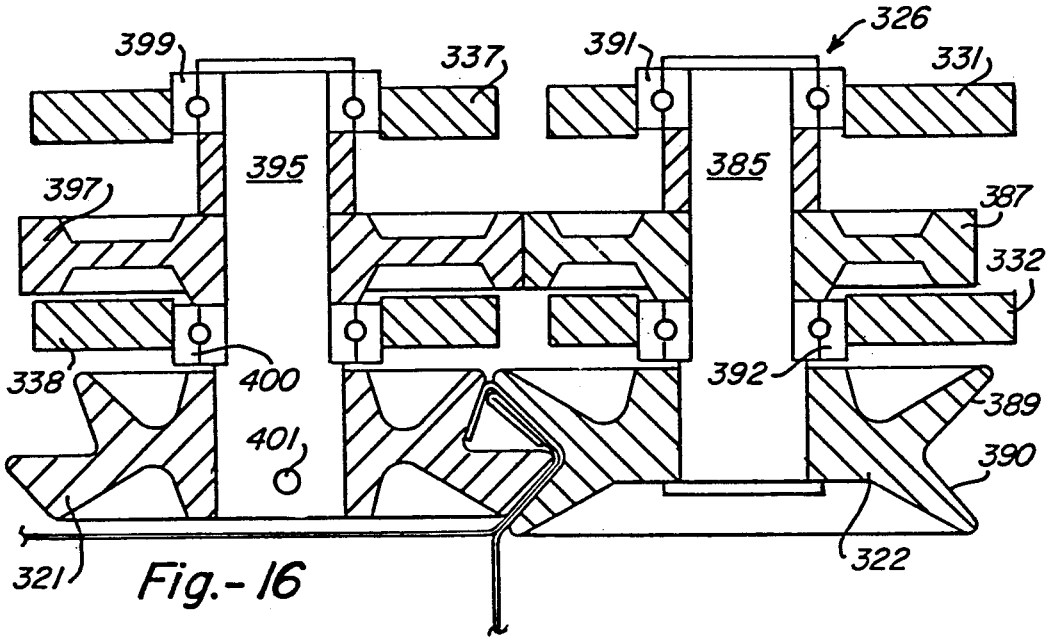
FIG. 16 is a sectional view taken along lines 16—16 of FIG. 10.
Figure 17:
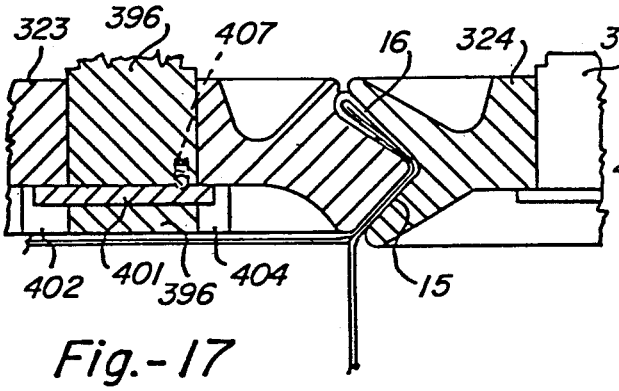
FIG. 17 is a sectional view taken along lines 17—17 of FIG. 10.
Figure 18:
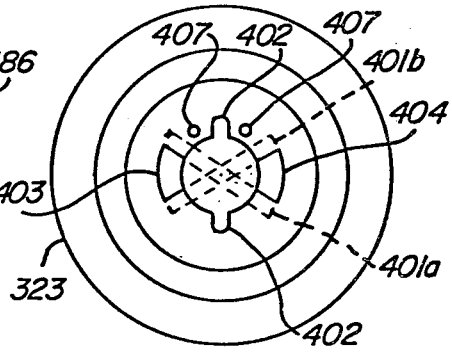
FIG. 18 is a bottom view of the outboard seaming roller shown in FIG. 17 when removed from the shaft and with the two positions of the shaft pin shown in dashed lines.

Referring now to FIG. 15, a reversible electric motor 411 carried by the inboard base portion has an output shaft 414 coupled through a power transmission train to move the seaming rollers. This power transmission train includes a main drive spur gear 416 on shaft 414 which meshes with a gear 417 on shaft 418. Shaft 418 is mounted on bearings in the inboard base portion of upper and lower plates 331 and 332. Shaft 418 carries a gear 419 which in turn meshes with drive gears 387 and 388 above described.

Figure 19:
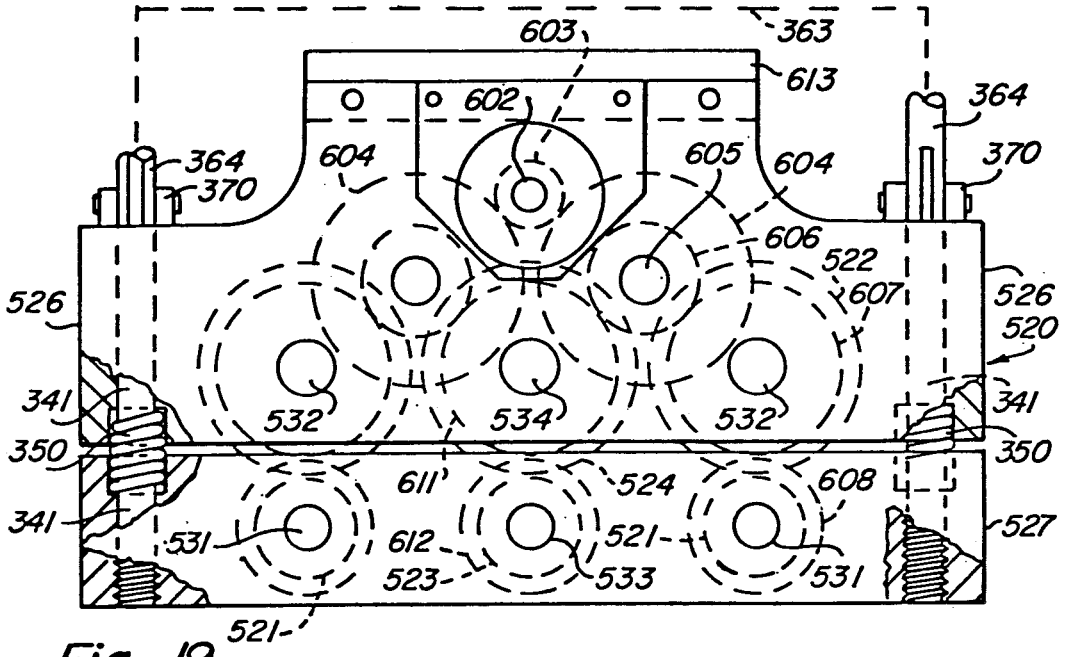
FIG. 19 is a top plan view of another form of seaming apparatus in the seaming position with the outline of the gears in the power train and the rollers shown in dashed lines.
Figure 20:
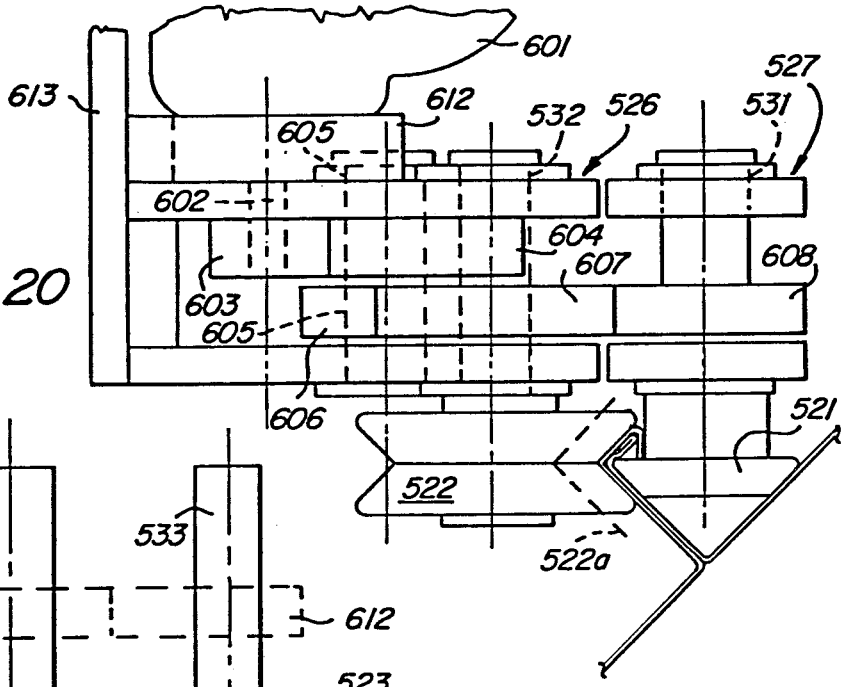
FIG. 20 is a side elevational view of the apparatus shown in FIG. 19.
Figure 21:
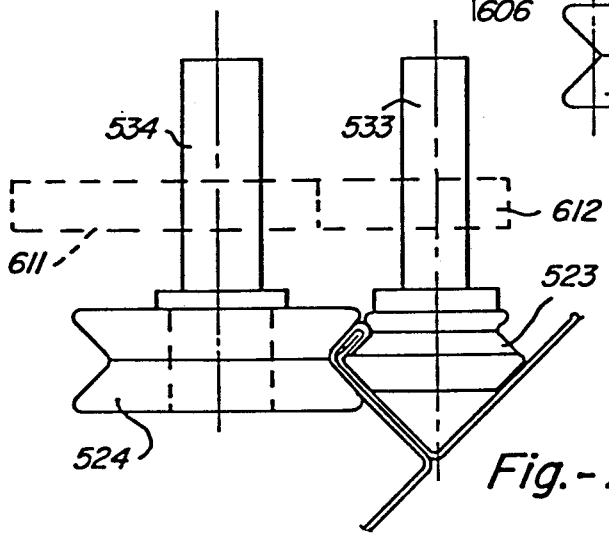
FIG. 21 is a fragmentary elevational view showing the second stage rollers of the apparatus shown in FIGS. 19 and 20.

The seaming apparatus shown in FIGS. 19–21 has a two-part supporting base 520 with an inboard base portion 526 and an outboard base portion 527. A first set of seaming rollers, which consists of an outboard roller 521 and an inboard roller 522, is mounted on base portions 527 and 526, respectively. A second set of seaming rollers, which consists of an inboard roller 523 and an outboard roller 524, and a third set of seaming rollers, which consists of an outboard roller 521 and an inboard roller 522, are mounted on base portions 527 and 526, respectively. Rollers 521 and 523 are mounted on the outboard base portion 527 and inboard rollers 522 and 524 are mounted on the inboard base portion. The first and third sets of rollers are identical so as to make the apparatus reversible.

Both the inboard and outboard base portions shown are constructed using upper and lower plates with spacer blocks in the same manner as above described and each uses the pairs of thrust pins and pivotal actuator arm 363 with interior compression springs 350 to move the inboard and outboard base portions relative to one another in the same manner as above described.

Each of the seaming rollers has an associated support shaft. Outboard roller 521 is mounted on outboard shaft 531, inboard roller 522 is mounted on inboard shaft 532, outboard roller 523 is mounted on outboard shaft 533, and inboard roller 524 is mounted on shaft 534.

An electrical reversible motor 601 is mounted on a mounting block 612 on the inboard base portion and is further supported by an upright mounting plate 613. The motor has an output shaft 602 which is coupled through a power transmission train to drive the seaming rollers.

This power transmission train includes a drive spur gear 603 mounted on the output shaft 602. The spur gear meshes with a top idler gear 604 and each of the idler gears is mounted on an associated shaft 605. Bottom cluster gear 606 is mounted on shaft 605 and these mesh with both the drive gear 607 on the shaft of the inboard roller 522 and the drive gear 611 on the inboard roller 524 to drive that inboard roller. The outboard roller 521 has a driven gear 608 which meshes with gear 607 in the seaming position to provide for rotation of the outboard roller 521. Outboard roller 523 has a driven gear 612 which meshes with inboard gear 611 to drive shaft 523.

The shape of the first and second sets of rollers includes inboard rollers with a 90-degree V-groove which engage the two sides of the inverted channel and an arrangement on the inboard rollers to turn the terminal section under the inturned lateral section in the same manner as shown in FIGS. 20 and 21.

A feature of the peripheral surfaces of the present invention is that they avoid abrasion by being less than 90° to the axis of rotation of the roller. The least abrasion occurs when the surface is parallel to the surface being engaged. The illustrative embodiments have the peripheral surfaces turned no more than 60° to a peripheral surface that is parallel to the axis of rotation.

From the foregoing it is apparent that the seaming apparatus can be constructed as a relatively lightweight unit, no intermediate idler roller section is required, the rollers are readily replaced, all rollers are positively driven, and the apparatus is readily attached and removed.

Although the present invention has been described with a certain degree of particularity, it is understood that the present disclosure has been made by way of example and that changes in details of structure may be made without departing from the spirit thereof.

What is claimed is:

1. Seaming apparatus for joining together adjacent outturned and inturned side edge portions of two adjacent panels along a continuous connecting seam when moved in either direction along the seam, the outturned side edge portion including an upstanding side section, outturned lateral flange sections and a downturned terminal section forming an exterior inverted channel prior to seaming, the inturned side edge portion being disposed within said outturned side edge portion and including an upstanding side section and an inturned lateral flange section extending along said outturned lateral flange section, said seaming apparatus comprising:

first and second sets of opposed seaming rollers rotatably mounted on a supporting means including a first base portion and a second base portion, said sets of seaming rollers having peripheral surface portions arranged to simultaneously bear against oppositely facing surface portions of at least one of said side edge portions, said first and second sets being spaced from one another along said base portions to successively engage opposite surfaces of said oppositely facing surface portions to track thereon and bend said terminal section back under said inturned lateral flange section to form a continuous connecting seam as said rollers are moved along said panels, one roller of each set being supported on said first base portion, said second base portion supporting the other roller of each said set, said first and second base portions being joined for guided movement toward and away from one another between a first position for seaming and a second position while maintaining the axes of the rollers of each set substantially parallel during said movement of said rollers;

means for moving said base portions between said positions and having means for releasably locking said base portions in said second position; and drive means for simultaneously rotating each of said seaming rollers to move said rollers and said supporting means along said two adjacent panels.

2. Seaming apparatus as set forth in claim 1 wherein at least one roller of each of said sets has a peripheral surface portion shaped to extend under and in engagement with an overhanging surface of the associated panel side edge portion to aid in holding the rollers on said edge fastening portions during the seaming operation.

3. Seaming apparatus as set forth in claim 1 wherein the axes of the rollers of each set are substantially parallel and said axes are oriented closer to being vertically disposed than horizontally disposed so that said peripheral surface portions approach more from opposite sides than from the top and bottom.

4. Seaming apparatus as set forth in claim 1 wherein each of said rollers is mounted on a shaft rotatably mounted on a bearing mounted in said supporting base, said shaft having a gear affixed thereto between the top and bottom, the roller being affixed at the bottom of the shaft.

5. Seaming apparatus as set forth in claim 1 wherein said actuating means includes a pair of clamping blocks mounted on said second base portion outside the rollers carried by said second base portion and a pair of spaced reciprocally movable push-pull clamp assemblies releasably connected at one end to an associated of said clamping blocks and connected at the opposite end by a common actuating arm that moves between two positions to move said push-pull clamp assemblies.

6. Seaming apparatus as set forth in claim 5 wherein each push-pull clamp assembly includes a base having a tubular socket together with a plunger slidable in the socket, said plunger being releasably connected at one end to an associated clamping block and connected at the other end to an over-center pivotal assembly arranged to move the plunger between an extended and a retracted position, said actuating means including a lever that simultaneously moves both clamp assemblies, said connection between the plunger being adjustable in length to vary the spacing between each set of rollers, said releasable connection between said plunger and said clamping block including a removable locking pin.

7. Seaming apparatus as set forth in claim 1 wherein said first base portion has opposite guideways to carry stepped end portions of said movable base portion in a guided sliding movement.

8. Seaming apparatus as set forth in claim 1 wherein said second base portion is removable from said first base portion, said first base portion having guiding means operatively associated with surfaces of said second base portion in a reversed position relative to said second base portion to reverse the position of said second rollers.

9. Seaming apparatus as set forth in claim 1 wherein said drive means includes a reversible motor mounted on said supporting means and a gear train transmitting power from the motor to said rollers, said gear train including a main drive gear and a gear associated with each of said rollers, the main drive gear meshing with the gears associated with said other rollers and in turn meshing with gears on the associated one roller of each set.

10. Seaming apparatus as set forth in claim 9 wherein the movement of said one roller of each set to said second position disengages said one roller of each set from being rotated by the main drive gear.

11. Seaming apparatus as set forth in claim 1 wherein each of said rollers has an inner hub and an outer rim, said rim including a pair of opposed ridges with inclined surfaces defining a generally V-shaped peripheral groove, each said ridge having a rounded crest furthest from the hub and a rounded root portion closest to the hub to embrace a corner juncture between two angularly disposed sections of the side edge portions of one panel and to turn a terminal side section of one panel under a lateral flange section of the other panel.

12. Seaming apparatus as set forth in claim 11 wherein one inclined surface increases in each succeeding set to turn said terminal side section.

13. Seaming apparatus for joining the adjacent side edge portions of two adjacent panels along a continuous seam, one panel having an outturned side edge portion including a terminal side section and the other panel having an inturned side edge portion nested in said outturned side edge portion, said seaming apparatus comprising:

a base including a main base portion and a movable base supported for guided movement laterally toward and away from said main base portion and removable from said main base portion;

a reversible drive motor mounted on said base;

a hand grip mounted on said base;

a leading set of seaming rollers and a trailing set of seaming rollers mounted on said base, said rollers having generally V-shaped peripheral surfaces arranged to successively engage the side edge portions of said adjacent panels, the rollers of each set being oppositely disposed, one roller of each set being rotatably mounted on said movable base portion, the axes of said sets of rollers being substantially parallel, each of said sets being substantially coplanar and engaging the side edge portions to bend the terminal side section of one panel back against the lateral section of the other panel to track on and form a longitudinally continuous connecting seam as the rollers are rotated by said drive motor through a power transmission train coupled between said motor and said rollers;

a pair of clamping blocks mounted on said movable base portion outwardly of said rollers; and a pair of push-pull clamps operated by a common actuating lever, the clamps being releasably connected at the end opposite the lever, the clamps being movable between operating and spaced positions, each clamp having an over-center pivot to lock the rollers in the operating position.

14. Seaming apparatus as set forth in claim 1 wherein said first base portion has a pair of end portions at opposite ends beyond said rollers provided with slide bores arranged parallel to one another, said second base portion having a pair of pins each affixed at one end and extending through said slide bores, said pins being freely slidable in said slide bores for the guided movement of said first and second base portions toward and away from one another.

15. Seaming apparatus as set forth in claim 14, further including resilient means bearing against opposite inset surfaces of said first and second base portions along the axes of said pins to urge said base portions in the direction of said second position.

16. Seaming apparatus as set forth in claim 1 wherein said actuating means includes an actuator arm having a pair of lever rods arranged parallel to one another and connected at outer ends by an engagement bar, and a clevis with a pair of arms and a transverse base connected to the ends of each lever rod, each clevis being pivotally connected to an end portion of the pins that extends beyond the first base portion to support the actuator arm for movement between a lowered position corresponding to the first position for said base portions and a raised position corresponding to the second position for said base portions.

17. Seaming apparatus as set forth in claim 16 wherein said pins thread into the associated end portions of said second base portion and said engagement bar is removably fastened to said lever rods whereby, upon removal of said engagement bar, said pins are rotated to change the spacing between said second base portion in said first position.

18. Seaming apparatus as set forth in claim 1, further including a third set of seaming rollers identical to said first set mounted on said supporting means to perform the same seaming operation as said first set when the direction of said supporting means is reversed end for end.

19. Seaming apparatus as set forth in claim 1 wherein each of said second set of rollers has a slot in a hub portion and stop surfaces on the hub portion, and an associated shaft for the hub has a pin that slides through the slot and engages the stop surfaces during rotation in either direction to permit a quick interchange of said outboard rollers for movement of said supporting means in the reverse direction along the seam.

20. Seaming apparatus as set forth in claim 1 wherein the spacing between each of said sets of rollers in said second position is sufficient to permit said sets of rollers to be placed down over and along said inverted channel at any point along said side edge portions prior to seaming and be lifted up and removed at any point along the seam after said seaming.

* * * * *